US005651452A

United States Patent [19]

Schaeffeler et al.

[11] Patent Number: 5,651,452

[45] Date of Patent: Jul. 29, 1997

[54] ELECTRIC SWITCH HAVING A PIVOTAL CONTACT LINK-ACTUATING ARM

[75] Inventors: Alois Schaeffeler, Spaichingen; Axel Riess, Tuttlingen, both of Germany

[73] Assignee: Marquardt GmbH, Rietheim-Weilheim, Germany

[21] Appl. No.: 543,938

[22] Filed: Oct. 17, 1995

[30] Foreign Application Priority Data

Oct. 17, 1994 [DE] Germany ..... 44 37 020.2

[51] Int. Cl.[6] ..... H01H 13/20

[52] U.S. Cl. ..... 200/437; 200/533

[58] Field of Search ..... 200/437, 439, 200/533

[56] References Cited

U.S. PATENT DOCUMENTS

| | | | |
|---|---|---|---|
| 3,999,024 | 12/1976 | Marquardt | 200/437 |
| 4,006,333 | 2/1977 | Hults | 200/437 |
| 4,459,448 | 7/1984 | McDill | 200/437 X |

FOREIGN PATENT DOCUMENTS

| | | |
|---|---|---|
| 0451633 | 10/1991 | European Pat. Off. . |
| 2162852 | 5/1973 | Germany . |
| 2412812 | 2/1976 | Germany . |
| 37 13 775 | 11/1988 | Germany . |
| 37 14 632 | 11/1988 | Germany . |
| 40 11 875 | 10/1991 | Germany . |
| 42 16 454 | 12/1992 | Germany . |
| 43 02 185 | 3/1994 | Germany . |
| 94 02 333 | 5/1994 | Germany . |
| 142-2254-A | 9/1988 | U.S.S.R. . |

*Primary Examiner*—Renee S. Luebke
*Attorney, Agent, or Firm*—Spencer & Frank

[57] ABSTRACT

An electrical switch includes a stationary contact supported in a housing; a movable contact displaceable between first and second states toward or away from the stationary contact; a blade stationarily supported in the housing; a contact link carrying the movable contact and being rockably supported on the blade to assume first and second pivotal positions thereon to place the movable contact into the first or second state; an operating device movably supported in the housing and being movable in opposite directions of displacement into an operated state and an unoperated state; a first resetting arrangement means for urging the operating device into the unoperated state; a pivotal arm extending from the operating device; a pivot bearing pivotally securing the pivotal arm to the operating device; an operating stud attached to the pivotal arm and cooperating with the contact link for placing the contact link into the first or second pivotal position as the operating device moves into the unoperated or operated state; and a second resetting arrangement for urging the pivotal arm and the operating stud toward the contact link. The pivot bearing and the operating stud are spaced from one another such that in the unoperated state the operating stud is in contact with the contact link and the pivot bearing is situated laterally adjacent the contact link relative to the directions of displacement of the operating device.

17 Claims, 5 Drawing Sheets

ELECTRIC SWITCH HAVING A PIVOTAL CONTACT LINK-ACTUATING ARM

Figure 1:
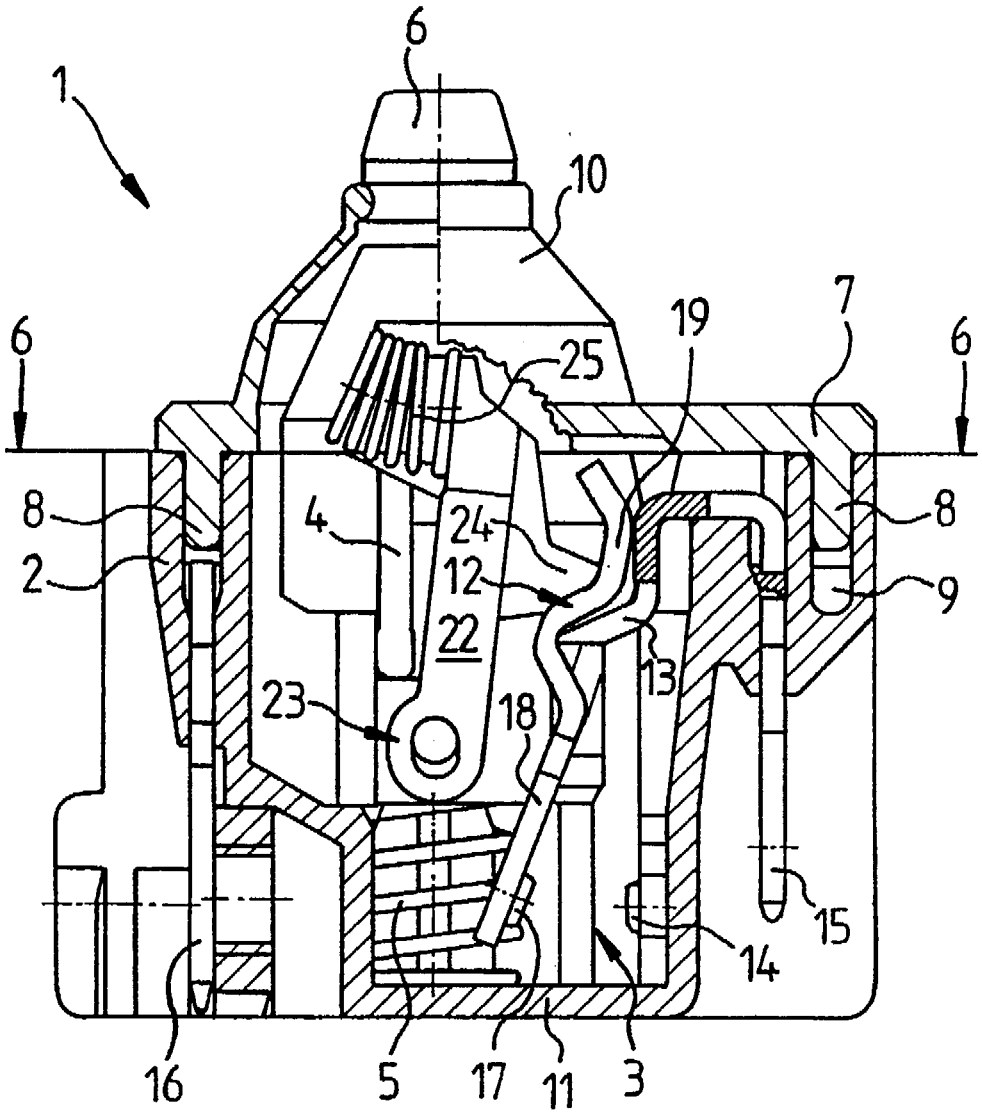

The invention relates to an electrical switch having an operating device which can be operated in a housing, preferably against a compression spring, for switching over at least one contact system including a contact link in the form of a rocker. The contact link is mounted such that it can rotate on a blade which acts as a contact bearing. The switch further has at least one stationary contact which interacts with the contact link. The switching over of the contact system on operation of the operating device is brought about by means of an operating stud which is arranged on the operating device such that it can move under the influence of a restoring force in the direction of the contact link.

Such a switch, disclosed, for example, in DE-OS 4,011, 875, can be produced in a single-pole or multipole design. It is primarily used as a mains switching hand-held electrical tool.

In the case of this switch, the operating device has a holder in the upper region, in which holder the operating stud is guided horizontally under the influence of a compression spring. When the operating device is operated, a problem can arise in the guidance of the operating stud, it being possible for said stud to jam. In such a case, the contact system does not switch over. In addition, the production and assembly of the holder and operating stud are costly.

The invention is based on the object of simplifying the arrangement of the operating stud on the operating device in the case of such a switch, and of improving its operational reliability.

This object is achieved by the invention, according to which, briefly stated, the electrical switch includes a stationary contact supported in a housing; a movable contact displaceable between first and second states toward or away from the stationary contact; a blade stationarily supported in the housing; a contact link carrying the movable contact and being rockably supported on the blade to assume first and second pivotal positions thereon to place the movable contact into the first or second state; an operating device movably supported in the housing and being movable in opposite directions of displacement into an operated state and an unoperated state; a first resetting arrangement means for urging the operating device into the unoperated state; a pivotal arm extending from the operating device; a pivot bearing pivotally securing the pivotal arm to the operating device; an operating stud attached to the pivotal arm and cooperating with the contact link for placing the contact link into the first or second pivotal position as the operating device moves into the unoperated or operated state; and a second resetting arrangement for urging the pivotal arm and the operating stud toward the contact link. The pivot bearing and the operating stud are spaced from one another such that in the unoperated state the operating stud is in contact with the contact link and the pivot bearing is situated laterally adjacent the contact link relative to the directions of displacement of the operating device.

The contact link of the contact system can thus be designed as a two-armed lever, a switching contact which interacts with the stationary contact being arranged on a first lever arm. The operating stud rests against the other, second lever arm in the unoperated state. A tab is located in the region between the two lever arms, with which tab the operating stud interacts, in the manner of a pressure point, when the contact system switches over. The arm which is fitted with the operating stud can be designed as a single-armed lever, its fulcrum being formed by the bearing point on the operating device. The operating stud is arranged on the arm at such a distance from the bearing point that, in the unoperated state, the former just rests against the second lever arm of the contact link.

The bearing point of the arm on the operating device can be formed by a pin which engages in an elongated hole, the elongated hole being designed to have a cross section greater than the pin. This allows the arm to carry out a movement in the direction of the operating device on operation, in addition to the pivoting movement. In consequence, a type of cascade effect occurs, as a result of which an increase in the contact force is achieved with the contact force between the switching contact and the stationary contact building up suddenly when the contact link is switched over.

In the case of a two-pole switch having two contact systems which are arranged side by side in the housing, it is then possible to connect the two arms, which are arranged on the operating device, by means of a transverse strut which is located on the side facing away from the bearing point, such that a U-shaped fork is formed on which the operating studs are located. In this case, it is sufficient to use only one compression spring acting on the transverse strut to produce the restoring force. In consequence, the number of parts is reduced and a cost saving for the switch is achieved. It can be advantageous in this case if the U-shaped fork has a certain amount of transverse elasticity, by means of which tolerances in the contact systems can be compensated for.

The advantages achieved by the invention comprise, in particular, the guidance of the operating stud on operation being improved. Even if the production tolerances are greater, canting over or jamming of the operating stud is effectively prevented, as a result of which the operational reliability of the switch is improved, with a high level of insensitivity to dust. In addition, the installation of the contact system for the switch is simplified. In consequence, the switch according to the invention can also be produced more cost-effectively.

Furthermore, the life is also increased. The contact system is suitable even for slow operating speeds, since the contact force is built up suddenly by a cascade effect. In addition, erosion on the contacts and premature failure of switch resulting from this are effectively prevented.

The contact system in the switch according to the invention can be miniaturized and nevertheless easily installed. Particularly in the case of electrical tool switches, relatively large inrush current surges, which are caused by the inductance of the electric motor, can be coped with even in the case of a reduced contact area, without welding of or damage to the contacts. In consequence, the switch can also have smaller dimensions overall. In addition, in the case of multipole switches, the number of parts for the contact systems is reduced, which in turn means more cost-effective production of the switch.

Figure 2:
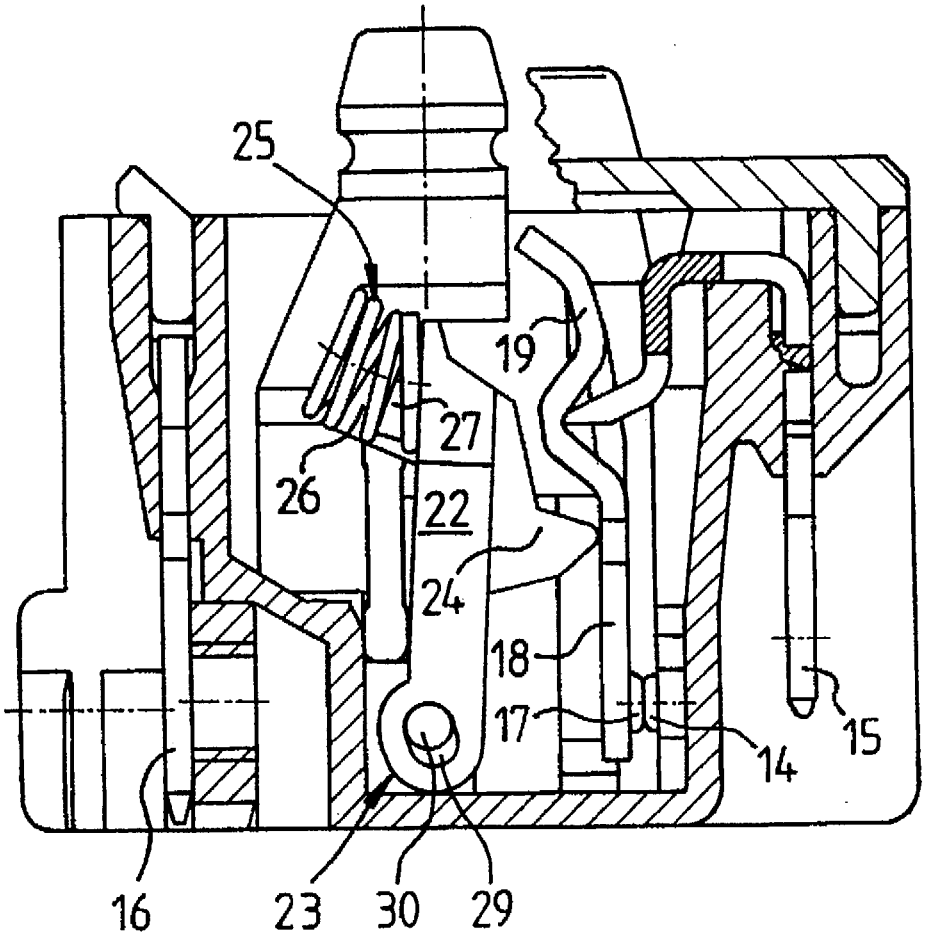
Figure 3:
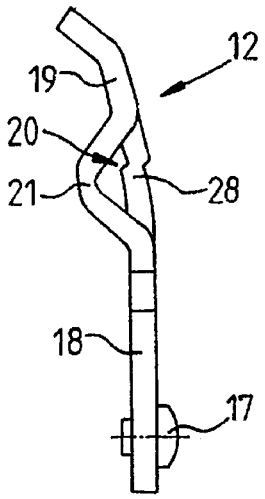
Figure 4:
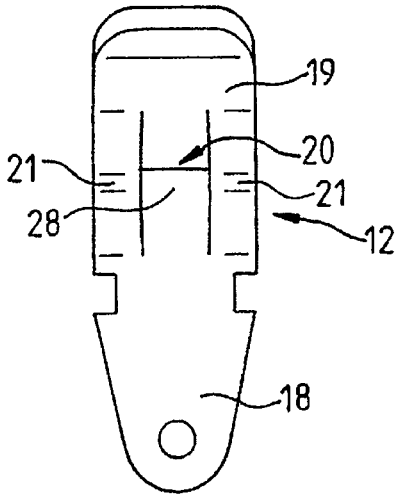
Figure 5:
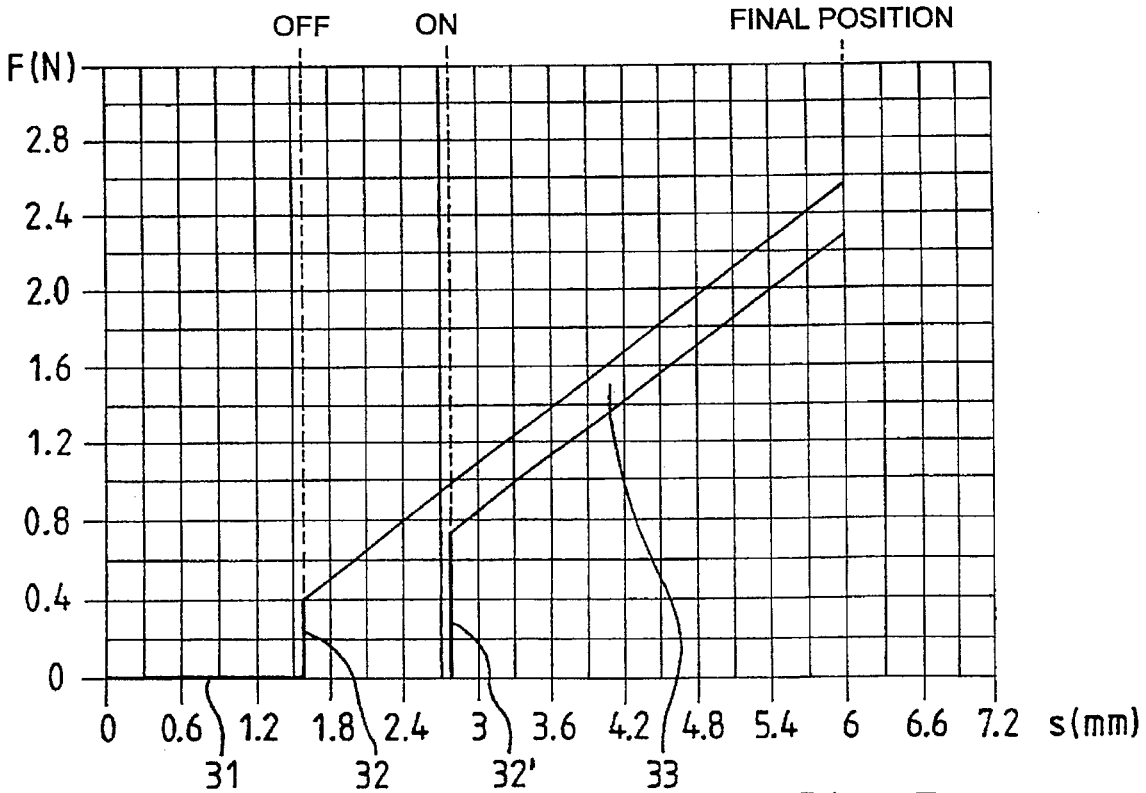
Figure 6:
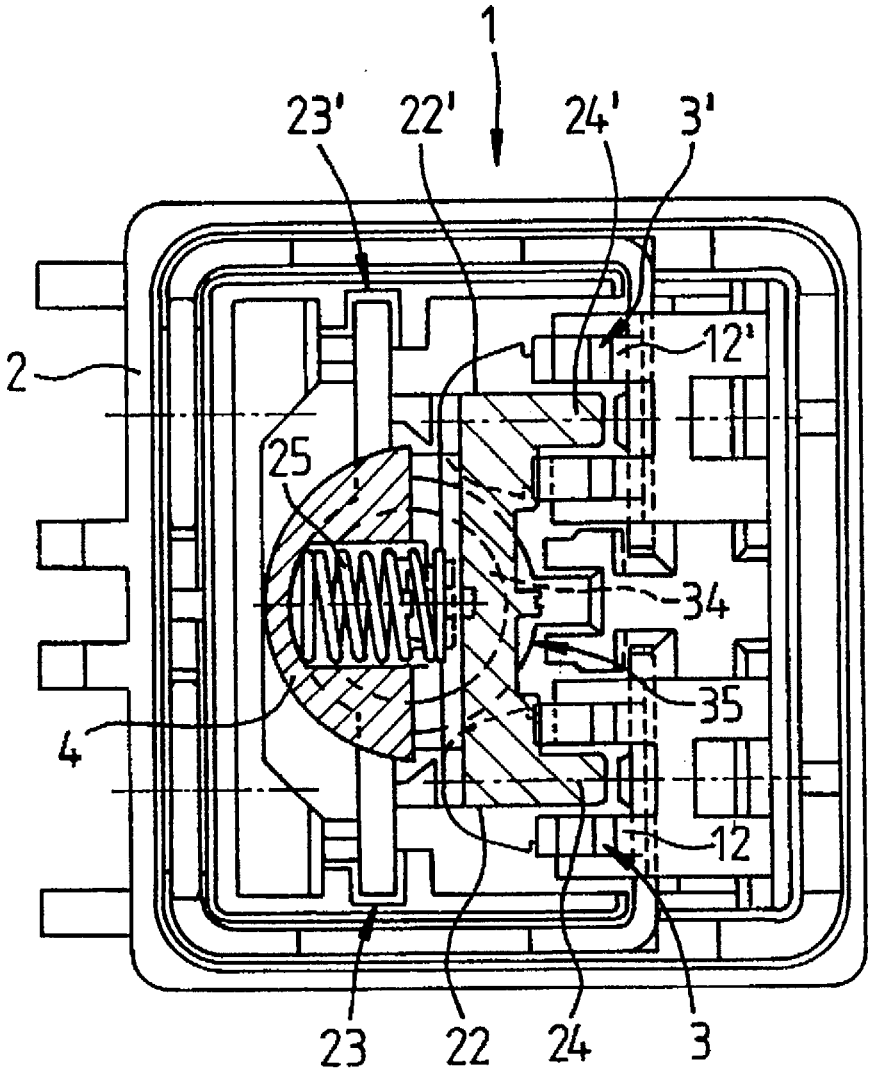
Figure 7:
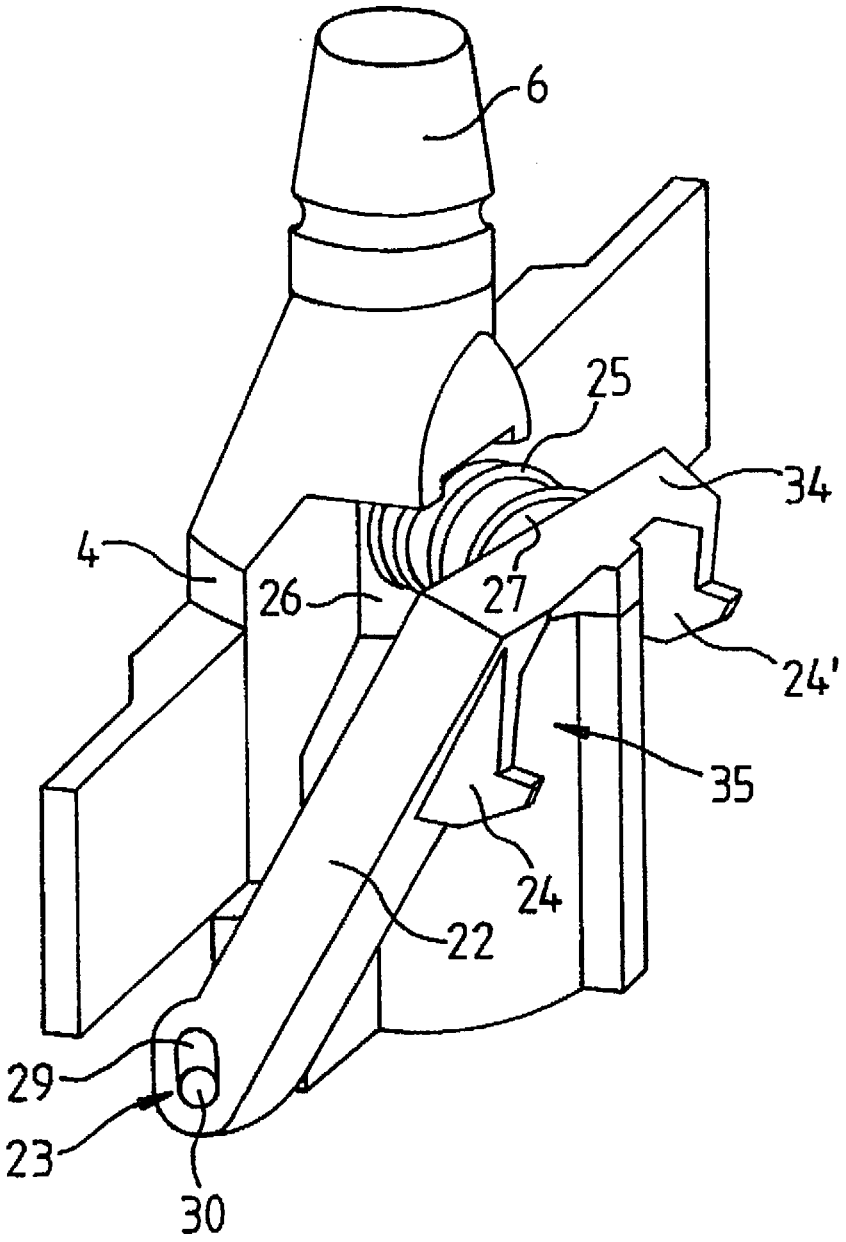

Exemplary embodiments of the invention are described in more detail in the following text and are illustrated in the drawings, in which:

FIG. 1 shows a longitudinal section through an electrical switch, the switch being in the unoperated state, FIG. 2 shows a partial longitudinal section similar to that in FIG. 1, but with the switch being in the operated state, FIG. 3 shows a side view of a contact link of the contact system, FIG. 4 shows a plan view of the contact link, FIG. 5 shows a diagram of the contact force for the electrical switch, FIG. 6 shows a cross section along the line 6—6 in FIG. 1 for a two-pole switch, and FIG. 7 shows a perspective view of the operating device of the two-pole switch in FIG. 6.

FIG. 1 shows an electrical switch 1 which can be used, in particular, as a mains switch in hand-held electrical tools. The switch i has an approximately pot-shaped housing 2 in whose interior a contact system 3 is arranged. The housing 2 is closed at the top by a cover 7 which engages by means of attachments 8 into a groove 9, which is circumferential on the edge of the housing 2, in order to achieve a good dust and moisture seal. An operating device 4, which can be operated linearly, is located in the housing 2 in order to switch over the contact system 3. The operating device 4 has a push button 6 which projects out of the housing 2. A compression spring 5, which is supported on the base 11 of the housing 2, is inserted in a holder on the operating device 4 in such a manner that the push button 6 exerts a restoring force on the operating device 4 when the operating device 4 is operated. An elastic bellows 10, in the form of a bell, is located on the cover 7 in the region of the push button 6. With the aid of which bellows 10 that region of the cover 7 is sealed where the push button 6 passes through said cover 7.

The contact system 3 comprises a contact link 12 which is in the form of a rocker and is mounted such that it can rotate on a blade 13 which acts as a contact bearing. The blade 13 is connected to an electrical connection 15 which is located on one side of the housing 2. A stationary contact 14 interacts with the contact link 12 and is connected via a contact rail, which runs in the housing 2, to a further electrical connection 16 on the other side of the housing 2. As can be seen in particular from FIGS. 3 and 4, the contact link 12, which is in the form of a rocker, has a first lever arm 18 provided with a switching contact 17, as well as a second lever arm 19. The two lever arms 18, 19 are connected to one another by an intermediate region 20. Located at the side on this intermediate region 20 are bulges 21 with whose aid the contact link 12 is mounted on the blade 13 such that it can move. At the same time, the contact link 12 is electrically connected via the blade 13 to the connection 15, so that the bulges 21 and the blade 13 form a contact bearing.

As is also shown in FIG. 1, an arm 22 is mounted in the interior of the housing 2, on the operating device 4, such that it can pivot about a bearing point 23. The arm 22 is designed as a lever, to be precise in the present exemplary embodiment as a single-armed lever, the fulcrum of the lever being formed by the bearing point 23. An operating stud 24, which is designed as an integral attachment on the arm 22, is located at a distance from the bearing point 23 on that side of the arm 22 which faces the contact link 12. The operating stud 24 is thus arranged such that it can move on the operating device 4 via the arm 22 and is subject to the influence of a restoring force in the direction of the contact link 12 in that a compression spring 25 acts on the arm 22. For this purpose, the compression spring 25 is held at one end in a holder socket 26 on the operating device 4 and at the other end on a retaining pin 27 which is located on that side of the arm 22 opposite the contact link 12, as can be seen from FIG. 2.

FIG. 1 shows the switch 1 in the unoperated (open) state. The bearing point 23 is now arranged on the operating device 4 in such a manner that the former is opposite the first lever arm 18 of the contact link 12 in the unoperated state. The operating stud 24 is furthermore at such a distance from the bearing point 23 that the former rests against the second lever arm 19 of the contact link 12 in the unoperated state. As a result of the force of the compression spring 25, the contact link 12 is in consequence held in a position in which the switching contact 17, which is located on the first lever arm 18, is away from the stationary contact 14 so that the electrical connection between the connections 15 and 16 is interrupted. The switch 1 is thus in the off position.

In order to switch the contact system 3 over, the operating device 4 has to be moved by means of the push button 6 against the force of the compression spring 5 in the direction of the interior of the housing 2. At the same time, the operating stud 24 slides along the contact link 12 from the second lever arm 19 to the intermediate region 20. As can best be seen in FIG. 3, a slightly projecting tab 28, which can be impressed in the intermediate region 20, is arranged on the intermediate region 20, which is essentially flat. As soon as the operating stud 24 abuts against the tab 28, an additional force must be applied in the direction of the compression spring 25 for further movement of the operating device 4, in order that the arm 22 can be deflected corresponding to the tab 28. Thus, when the operating device 4 is operated in order to switch the contact link 12 over, the tab 28 interacts with the operating stud 24 in the manner of a pressure point. Once the pressure point has been overcome, the operating stud 24 moves suddenly from the intermediate region 20 to the first lever arm 18. The arm 22 is then moved by the restoring force of the compression spring 25 together with the operating stud 24 in the direction of the contact link 12, so that the contact link 12 is moved around the blade 13 until the switching contact 17 rests against the stationary contact 14. The operated (closed) state, which can be seen in more detail in FIG. 2, is thus reached, the switch 1 being in the on position. In the operated state, an electrical connection is now produced between the connections 15 and 16, the operating stud 24 resting against the first lever arm 18 there.

The arm 22 can be made of plastic and can be produced as an injection-molded part with the integral operating stud 24. Alternatively, it is possible to produce the arm 22 as a metal stamping, the plastic operating stud 24 then being overmolded on to the metal part for electrical insulation. A compression spring 25 is arranged on the arm 22 in order to exert the restoring force. Alternatively, this restoring force can also be produced by elastic deformation of the arm 22 during movement of the operating device 4. In this case it is possible to design the arm 22 as a leaf spring, wire clip or the like.

A particularly advantageous refinement of the bearing point 23 for the arm 22 is shown in more detail in FIG. 2. The bearing point 23 comprises an elongated hole 29, which is arranged in the arm 22, and a pin 30 which engages in the elongated hole 29 and is in turn located on the operating device 4. The pin 30 can, of course, be located on the arm 22 and the elongated hole 29 like a blind hole in the operating device 4, the opposite way round. The elongated hole 29 is designed to have a cross section greater than the pin 30, for example by the elongated hole 29 having an oval cross section while the pin 30 has a round cross section. As a result of the elongated hole 29, in addition to the pivoting movement during operation by the push button 6, the arm 22 can carry out a movement which runs in the direction of the movement direction of the operating device 4. If the operating device 4 is now moved in order to switch the contact link 12 over, then this additional movement of the arm 22 in the elongated hole 29 takes place while overcoming the pressure point on the tab 28, as a result of which a further increase in the contact force is achieved with the contact force between the switching contact 17 on the contact link 12 and the stationary contact 14 being built up suddenly.

FIG. 5 shows the measurement curve for contact force F as a function of the operating movement s of the operating device 4 when switching over between the off position and the on position in the case of a switch 1 having such a bearing point 23 which comprises a pin 30 and an elongated hole 29. Until the operating stud 24 reaches the pressure point on the tab 28 of the contact link 12, the switching contact 17 is away from the stationary contact 14 and the contact force is zero, as can be seen on the curve section 31. When the pressure point is overcome, the contact link 12 snaps over like a cascade and the switching contact 17 comes into contact with the stationary contact 14. At the same time, the contact force builds up suddenly as can be seen from the vertically rising curve section 32'. In the event of further operation of the operating device 4, the contact force rises linearly in accordance with the curve section 33 until the end of the operating movement. When switching over from the on position to the off position, in the reverse direction, the contact force in turn falls suddenly to zero when the pressure point is overcome, as can be seen from the curve section 32. The distance between the two curve sections 32, 32' furthermore shows that the elongated hole 29 makes it possible to achieve a certain amount of hysteresis between the switching over processes when switching the switch 1 on and off. The sudden build-up and drop in the contact force advantageously effectively prevents creeping operation with slow contact between the switching contact 17 and the stationary contact 14 and the other negative effects, such as contact erosion or the like.

A two-pole switch 1 is shown in a further exemplary embodiment according to FIG. 6, which switch 1 has two identical contact systems 3, 3' of the type shown in FIG. 1, which can be switched over by means of an operating device 4. The two contact systems 3, 3', each having one contact link 12, 12', are arranged side by side in the housing 2, as can be seen from FIG. 6. An operating stud 24, 24' acts on each contact link 12, 12' in order to operate the contact systems 3, 3', said operating stud being arranged on an arm 22, 22' assigned to the respective contact link 12, 12'. Each arm 22, 22' is in turn mounted in a bearing point 23, 23' on the operating device 4 such that it can rotate, in a corresponding manner to that shown in FIG. 1, the two bearing points 23, 23' being located on the mutually opposite sides of the operating device 4. The two arms 22, 22' are connected to a transverse strut 34 on the side facing away from the bearing point 23, 23', so that the arms 22, 22' and the transverse strut 34 form a type of U-shaped fork 35, as can be seen, in particular, from the perspective view in FIG. 7. The compression spring 25 for exerting the restoring force acts on the transverse strut 34. The method of operation of this switch 1 is analogous to the method of operation already explained further above, and, in particular, an elongated hole arrangement can once again also be provided here on the bearing point 23, 23' in order to increase the contact force.

In the case of this further design, only one compression spring 25 and only one further part, designed as a fork 35, are advantageously required for the switching effect on the contact links 12, 12'. In consequence, the production and assembly costs in the case of a two-pole switch are reduced. It is furthermore advantageous if the fork 35 and the transverse strut 34 have a certain amount of transverse elasticity, as a result of which it is possible to compensate for tolerances in the contact systems 3, 3'. Greater tolerances in production and assembly can then be accepted in a more cost-effective manner.

The invention is not limited to the exemplary embodiments described and shown. Instead, it also comprises all developments apparent to the person skilled in the art in the context of the idea of the invention. Thus, the invention can be used not only in the case of electrical tool switches but it can, of course, also be used for other switches.

We claim:

1. An electrical switch comprising (a) a housing;

(b) a stationary contact supported in said housing;

(c) a movable contact displaceable in said housing between first and second states; one of said first and second states being an open state in which said movable contact is out of electrical engagement with said stationary contact and the other of said first and second states being a closed state in which said movable contact is in an electrical engagement with said stationary contact;

(d) a blade stationarily supported in said housing;

(e) a contact link rockably supported on said blade to assume first and second pivotal positions thereon; said movable contact being carried by said contact link; in said first pivotal position of said contact link said movable contact being in said first state and in said second pivotal position of said contact link said movable contact being in said second state;

(f) an operating device movably supported in said housing and being movable in opposite directions of displacement into an operated state and an unoperated state;

(g) a first resetting means for urging said operating device into said unoperated state;

(h) a pivotal arm extending from said operating device;

(i) a pivot bearing pivotally securing said pivotal arm to said operating device;

(j) an operating stud attached to said pivotal arm and cooperating with said contact link for placing said contact link into said first or second pivotal position as said operating device moves into said unoperated or operated state; and (k) a second resetting means for urging said pivotal arm and said operating stud toward said contact link; wherein said pivot bearing and said operating stud are spaced from one another such that in said unoperated state said operating stud is in contact with said contact link and said pivot bearing is situated laterally adjacent said contact link relative to said directions of displacement.

2. The electrical switch as defined in claim 1, said contact link including (a) a first lever arm carrying said movable contact;

(b) a second lever arm; said first and second lever arms extending in opposite directions from said blade; and (c) a generally planar intermediate region connecting said first and second lever arms with one another; said intermediate region including (1) lateral bulges forming contact bearings engaging said blade; and (2) a tab formed on and projecting from said intermediate region; said tab and said operating stud together acting as a pressure point for causing a rocking motion of said contact link during displacement of said operating device; further wherein in said operated state said operating stud is in engagement with said first lever arm and in said unoperated state said operating stud is in engagement with said second lever arm.

3. The electrical switch as defined in claim 1, wherein said pivotal arm is formed as a single-arm lever and further wherein said pivot bearing is arranged on said operating device such that in said unoperated state said pivot bearing faces said first lever arm of said contact link and said operating stud is spaced from said pivot bearing such that said operating stud engages said second lever arm of said contact link in said unoperated state.

4. The electrical switch as defined in claim 1, wherein in said unoperated state of said operating device said movable contact is in said open state and in said operated state of said operating device said movable contact is in said closed state; further wherein said pivot bearing comprises (a) an elongated opening having a length oriented approximately parallel to said directions of displacement; and (b) a pivot pin extending into said elongated opening; said pivot pin having a diameter less than said length, whereby during displacement of said operating device said pivotal arm, in addition to a pivotal motion, executes a translatory movement relative to said operating device for building a sudden contacting force during motion of said contact link from said first state to said second state.

5. The electrical switch as defined in claim 4, wherein said elongated opening is provided in said pivotal arm and said pivot pin is secured to said operating device.

6. The electrical switch as defined in claim 1, wherein said pivotal arm and said operating stud constitute a single-piece, injection-molded plastic member.

7. The electrical switch as defined in claim 1, wherein said pivotal arm is a stamped metal member and said operating stud is a plastic member injection-molded onto said stamped metal member.

8. The electrical switch as defined in claim 1, wherein said second resetting means comprises a compression spring having one end supported on said operating device and another end supported on said pivotal arm.

9. The electrical switch as defined in claim 1, wherein said pivotal arm is a leaf spring constituting said second resetting means.

10. An electrical switch comprising (a) a housing;

(b) stationary contacts supported in said housing;

(c) a blade stationarily supported in said housing;

(d) a contact link rockably supported on said blade to assume first and second pivotal positions thereon;

(e) movable contacts carried by said contact link; in said first pivotal position of said contact link said movable contacts being in a first switching state relative to said stationary contacts and in said second pivotal position of said contact link said movable contacts being in said second state relative to said stationary contacts;

(f) an operating device movably supported in said housing and being movable in opposite directions of displacement into an operated state and an unoperated state;

(g) a first resetting means for urging said operating device into said unoperated state;

(h) first and second pivotal arms being spaced from one another and extending from said operating device;

(i) a transverse strut connecting said first and second pivotal arms with one another; said first and second pivotal arms and said transverse strut together forming a U-shaped fork;

(j) first and second pivot bearings pivotally securing respective said first and second pivotal arms to said operating device;

(k) first and second operating studs attached to said respective first and second pivotal arms and cooperating with said contact link for placing said contact link into said first or second pivotal position as said operating device moves into said unoperated or operated state; and (l) a second resetting means exerting a resetting force to said transverse strut for urging said first and second pivotal arms and said first and second operating studs toward said contact link.

11. The electrical switch as defined in claim 10, wherein said second resetting means comprises a compression spring having one end supported on said operating device and another end supported on said transverse strut.

12. The electrical switch as defined in claim 10, said contact link including (a) a first lever arm carrying said movable contacts;

(b) a second lever arm; said first and second lever arms extending in opposite directions from said blade; and (c) a generally planar intermediate region connecting said first and second lever arms with one another; said intermediate region including (1) lateral bulges forming contact bearings engaging said blade; and (2) a tab formed on and projecting from said intermediate region; said tab and said operating studs together acting as a pressure points for causing a rocking motion of said contact link during displacement of said operating device; further wherein in said operated state said operating studs are in engagement with said first lever arm and in said unoperated state said operating studs are in engagement with said second lever arm.

13. The electrical switch as defined in claim 10, wherein said first and second pivotal arms are formed as single-arm levers and further wherein said first and second pivot bearings are arranged on said operating device such that in said unoperated state said first and second pivot bearings face said first lever arm of said contact link and said first and second operating studs are spaced from respective said first said second pivot bearings such that said first and second operating studs engage said second lever arm of said contact link in said unoperated state.

14. The electrical switch as defined in claim 10, wherein in said unoperated state of said operating device said movable contacts are spaced from respective said stationary contacts and in said operated state of said operating device said movable contacts are in electric contact with said respective stationary contacts; further wherein said first and second pivot bearings each comprise (a) an elongated opening having a length oriented approximately parallel to said directions of displacement; and (b) a pivot pin extending into said elongated opening; said pivot pin having a diameter less than said length, whereby during displacement of said operating device the respective said pivotal arm, in addition to a pivotal motion, executes a translatory movement relative to said operating device for building a sudden contacting force during motion of said contact link from said first state to said second state.

15. The electrical switch as defined in claim 14, wherein said elongated opening is provided in each said pivotal arm and said pivot pin is secured to said operating device.

16. The electrical switch as defined in claim 10, wherein said contact link is formed of two contact link parts each carrying a separate said movable contact and further wherein a first of said movable contacts cooperates with a first of said stationary contacts and a second of said movable contacts cooperates with a second of said stationary contacts; said first stationary and first movable contacts forming a first contact system and said second stationary and second movable contacts forming a second contact system.

17. The electrical switch as defined in claim 16, wherein said transverse strut has a sufficient elasticity to compensate for tolerances in said first and second contact systems.

* * * * *